US006551180B2

(12) United States Patent
Braasch

(10) Patent No.: US 6,551,180 B2
(45) Date of Patent: Apr. 22, 2003

(54) GRINDING TOOL

(76) Inventor: Gerd Braasch, Sassenberg 31, D-49751 Sögel (DE)

( * ) Notice: Subject to any disclaimer, the term of this patent is extended or adjusted under 35 U.S.C. 154(b) by 0 days.

(21) Appl. No.: 09/910,623

(22) Filed: Jul. 20, 2001

(65) Prior Publication Data

US 2002/0009965 A1 Jan. 24, 2002

(30) Foreign Application Priority Data

Jul. 22, 2000 (DE) ..... 200 12 746

(51) Int. Cl.[7] ..... B24D 17/00
(52) U.S. Cl. ..... 451/508; 451/521
(58) Field of Search ..... 451/508, 521

(56) References Cited

U.S. PATENT DOCUMENTS 252,928 A * 1/1882 Buzzell ..... 451/508
3,191,351 A * 6/1965 Balz ..... 451/342
3,540,160 A * 11/1970 De Rose et al. ..... 451/344
3,742,656 A * 7/1973 Amos ..... 403/359.2
3,883,998 A * 5/1975 Dosser ..... 451/508
5,390,449 A * 2/1995 Hilton ..... 451/490

FOREIGN PATENT DOCUMENTS

DE 87 16 114.1 10/1988
DE 40 20 461 7/1991

* cited by examiner

*Primary Examiner*—M. Rachuba
(74) *Attorney, Agent, or Firm*—Collard & Roe, P.C.

(57) ABSTRACT

A grinding tool to be driven by a rotating machine drive comprises a carrier body in the form of a disk. The disk can be attached to the machine drive by means of a connecting element located at approximately the area of the center of rotation. The carrier body has at least one working side equipped with a grinding element. The grinding element takes the form of a disk leaf, i.e. a thin or leaf-like disk disposed radially in relation to the axis of rotation. The periphery of the disk protrudes by a predetermined amount beyond the outer edge of the working side of the carrier body. The grinding element disk comprises at least two disk layers attached to one another. A first layer of the disk is an elastic cushioning layer, and a second layer of the disk is a highly flexible grinding linen.

8 Claims, 2 Drawing Sheets

GRINDING TOOL

CROSS REFERENCE TO RELATED APPLICATIONS

Applicant claims priority under 35 U.S.C. §119 of German Application No. 200 12 746.2 filed Jul. 22, 2000.

BACKGROUND OF THE INVENTION

1. Field of the Invention

The invention relates to a rotating machine grinding tool. In particular, the invention relates to a grinding tool that comprises a carrier body in the form of a disk which has a working side equipped with a grinding element. The disk can be attached to a machine drive by means of a connection element located in about the area of the center of rotation.

2. The Prior Art

Grinding machines are used to grind profiled surfaces of workpieces. It is known to mold into the working sides of such machines contours negatively corresponding with the contour of the profile that is to be ground. An abrasive agent is then attached or glued to the contoured working side in order to grind the workpiece. So as to avoid so-called "burning" caused by extreme frictional heat at a higher grinding contact pressure, it has previously been proposed to arranged a cushioning layer, for example a layer made of an elastic, cellular foam material, between the working side and a grinding linen. Relatively soft grinding can be effected in this way, which may be suitable even for grinding lacquer, if need be.

Particularly when equipped with a cushioned grinding element, the working side also may more or less adapt itself to variations in the shape of the workpiece depending on the grinding pressure. However, this adaptation is limited by the elasticity of the cushioning layer used, and also by the elasticity of the material employed for the carrier body or the area of its working side. For example, the areas of transition or connection of assembled workpieces often comprise surfaces that are difficult to grind. Such difficulty is present particularly in cases where the workpiece is a profile, or comprises sections adjoining each other within the zone of connection at a predetermined angle. This is often the case in conjunction with staircase railings.

Such zones can often be ground only by hand using suitable grinding elements such as grinding linen, abrasive paper or the like, in a labor-intensive manner.

The invention addresses the problem of providing a grinding tool that can be easily used and applied for many different purposes, and applied in conjunction with suitable machines even if difficult configurations need to be ground in difficult spots as well.

SUMMARY OF THE INVENTION

The problem is solved according to the invention by providing a grinding element in the form of a disk leaf, i.e. a thin or leaf-like disk that is set radially in relation to the axis of rotation, and whose periphery protrudes beyond the outer edge of the working side of the carrier body by a predetermined amount.

When the carrier body is rotating, grinding can be carried out with the disk leaf, which is disposed radially in relation to the axis of rotation, by guiding the abrasive side of the disk leaf that is facing away from the working side of the carrier body, across the surface of the workpiece to be ground, like a grinding wheel. This can be accomplished by freely guiding a connected, corresponding machine drive by hand.

The grinding element takes the form of a relatively thin and, therefore leaf-like disk. The centrifugal forces caused by the rotation stretch the grinding element, and such stretching stiffens the grinding element. Nevertheless, the area of the grinding element that clears or freely projects beyond the outer edge of the working side of the carrier body remains yielding or flexible versus the forces acting transversely in relation to the plane of rotation. The freely protruding portion will yield to projections on the workpiece during rotation. In this way, the grinding contact pressure required for grinding the workpiece projection will be maintained without increasing that contact pressure to an undesirable order of magnitude.

The grinding tool as defined by the invention does not comprise any fixed support flange for the actual abrasive coating that is applied to the surface of the disk leaf. Advantageously, this feature makes it possible for the abrasive coating, which remains highly flexible, to grind three-dimensional configurations, planes and transitions in shape without any problems. Grinding of such structures has been possible heretofore only by means of the so-called freehand grinding method, in which process a grinding means, for example abrasive paper placed around a hand-held block element, is both moved and guided by hand, i.e. manually. The machine grinding tool as defined by the invention consequently can be operated in a variable manner accordingly, like the grinding device used in free-hand grinding operations; however, with substantially superior grinding efficiency and better grinding results.

The machine grinding tool as defined by the invention is capable of grinding in all areas of deformed planes. The tool is also able to grind in all areas of transition in the configuration, or areas of transition between individual components. In each case, the tool grinds with a constant contact pressure and has as a special advantage, the optimal contact pressure resulting from soft grinding.

It is very important in connection with the grinding tool as defined by the invention that the supporting elements, in the present case the carrier body with its connecting elements, have a much smaller diameter than the grinding element, i.e. the disk leaf. The dimensional stability of the disk leaf is achieved solely by the centrifugal force generated at a predetermined rotational speed. The selected diameters permit deformation over a large area in the actual grinding plane. This feature makes it possible to readily grind difficult configurations of a workpiece.

It is particularly advantageous if the disk leaf comprises at least two disk layers resting against one another. A first layer of the disk is a layer of an elastic cushion and a second layer is a highly flexible grinding linen. Both layers are circular rings punched from suitable materials. Such circular rings are attached to each other by suitable measures for joining them, for example by gluing. The outside diameter of the second layer consisting of highly flexible grinding linen is dimensioned in such a way that it freely projects to a predetermined extent beyond the outer edge of the first layer, which is the elastic cushioning layer.

This embodiment offers the advantage that the elastic cushioning layer jointly supports the inner areas of the grinding tool. These areas are located adjacent to the center of rotation where the centrifugal forces cannot exert the same stiffening effect as they do along the periphery. The elasticity of this cushioning layer leads to soft grinding action in these areas as well even though these areas are located close to the axis of rotation.

The predetermined amount by which the outer edge of the second layer of the disk leaf clears or freely protrudes beyond the outer edge of the first layer of the disk leaf, which is the cushioning layer, is at least equal to the thickness of the cushioning layer. With a thickness of the cushioning layer of, for example 3 mm, the outer edge of the second layer of the disk leaf freely projects beyond the outer edge of the first layer by 5 mm in a preferred embodiment. Therefore, in this embodiment, the outer edge of the second layer projects by more than the thickness of the cushioning layer.

According to an advantageous embodiment, the carrier body takes the form of a disk ring as well, which is so thin that its peripheral area is capable of elastically yielding transversely to the plane of the disk ring. In this embodiment, the disk ring has an attachment for the connecting element that is located in the center of the disk ring. The shape and form of this attachment are selected so that the attachment of the carrier body is in the form of a sleeve, whereby the disk ring corresponds with a collar flange projecting from the sleeve in an approximately radial manner.

The grinding element may be connected with the carrier body by gluing its cushioning layer to the thin and therefore elastic collar flange. The carrier body is preferably a single-piece, molded component made of glass fiber-reinforced polyamide. This material possesses high strength on account of its glass fiber reinforcement and also exhibits adequate elasticity by dimensioning the collar flange so that it is approximately equal to one twentieth of its width. It is also advantageous, furthermore, that this material can be caused to slightly start to dissolve with defined solvents, so that the grinding element can be readily glued to a surface starting to dissolve. No additional adhesive is needed.

The carrier body equipped with the grinding element is a favorably priced disposable component that can be simply replaced when it is worn. Carrier bodies made of glass fiber-reinforced polyamide can be manufactured as mass-produced articles in the injection molding process. The grinding elements can be produced in series on the industrial scale as well. With the grinding tool of the present invention, it is no longer necessary to mold the negative form of the profile to be ground into the working sides of grinding tools in order to work in defined profiles in contour grinding operations.

The grinding element present in the form of a disk leaf has a hole in the center, the diameter of which is about equal to, but not less than the outside diameter of the sleeve of the carrier body. Thus the grinding element with the hole can be plugged over the sleeve of the carrier body, whereby it is glued to the sleeve with its cushioning layer resting against the collar flange.

The outside diameter of the elastic cushioning layer of the grinding element present in the form of a disk is approximately equal to three times the width of the collar flange of the carrier body. The thickness of the elastic cushioning layer is approximately equal to three times the thickness of the collar flange as well. With an outside diameter of the collar flange of, for example 70 mm, and a width of about 10 mm, the collar flange has a thickness of about 1 mm.

Thus the collar flange is a highly elastic, springy component supporting the grinding element in the center. Such support grows gradually softer in the direction of the outside diameter of the collar flange and thus over the radial spacing from the center of rotation. This arrangement is desirable for achieving optimal grinding results with the grinding tool as defined by the invention as well. The grinding tool according to the invention permits grinding sharp-edged corners. The elasticity of its grinding element prevents flat grinding contours from occurring on curved workpieces due to excessive grinding pressure. Transitions of surfaces on workpieces are simultaneously ground as well because the grinding element nestles itself to all planes in the transition area. The relatively soft grinding element of the grinding tool as defined by the invention prevents undesirable heat from building up, for example when grinding workpieces made of stainless steel. Such materials could otherwise cause undesirable discoloration of a workpiece due to frictional heat.

BRIEF DESCRIPTION OF THE DRAWINGS

Other objects and features of the present invention will become apparent from the following detailed description considered in conjunction with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
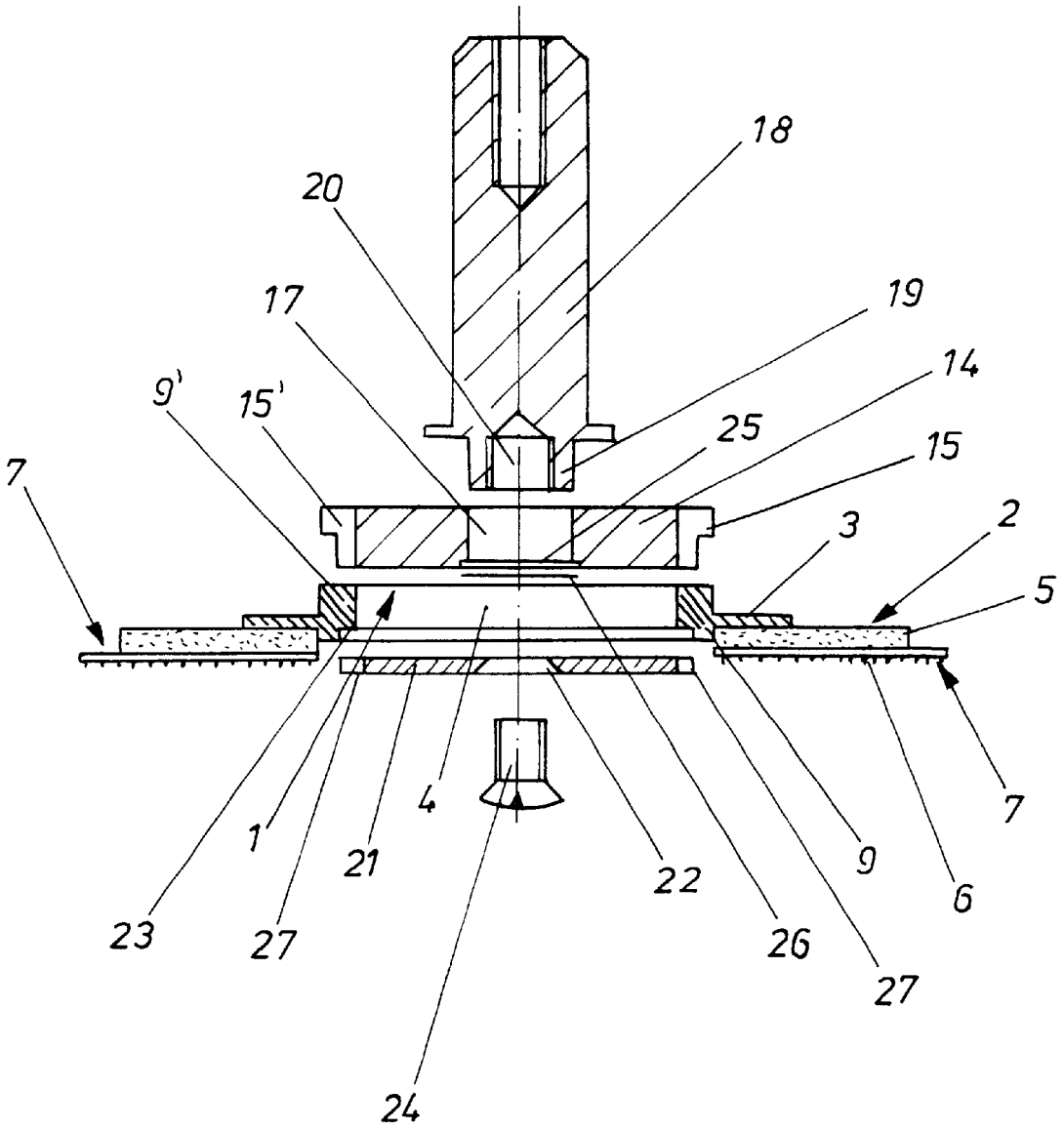
FIG. 1 is a sectional side exploded view of a grinding tool in accordance with the invention.

FIG. 1 shows a side view of a grinding tool. The grinding tool has a carrier body 1 and a grinding element 2 arranged on the periphery of carrier body 1. In the center of carrier body 1 is a short sleeve 4 having a length of about 7 mm. The sleeve permits the carrier body to be attached via connecting elements to a machine drive. Carrier body 1 includes a thin disk 3 in the form of a collar flange projecting radially from sleeve 4. Disk 3 has a thickness, for example 1 mm, so that it is capable of elastically yielding transversely to the plane of the disk.

FIG. 1 shows a particularly advantageous embodiment for connecting the grinding tool to the machine drive. In this embodiment, carrier body 1 is installed in clamping ring 14 so that drivers 9 and 9' are received in a form-locked manner in the grooves 15 and 15' located on the periphery of clamping ring 14.

Clamping ring 14 has an inner bore 17 provided with a lower bushing or widening 25 in which a conventional spring ring 26 can be inserted. Inner bore or recess 17 receives a clamping pin 18 inserted therein. A clamping lid 21 is attached to carrier body 1 on the side opposite to clamping pin 18 and secured thereon by countersunk screw 24. Clamping lid 21 has grooves 27 and 27' cut into its circumference. Clamping lid 21 may be rotated so that the grooves align with the drivers on the carrier body and carrier body 1 can be pulled away downwards without having to remove clamping lid 21. Similarly, with the grooves so aligned, a new grinding tool including carrier body 1 and grinding element 2 may be mounted from the bottom. As long as the countersunk screw 24 has not been tightened, spring disk 26 pushes clamping lid 21 away from clamping ring 14, thereby permitting clamping lid 21 to be readily turned into a position aligned with drivers 9 and 9'. With the clamping lid in this position, drivers 9 and 9' pass through grooves 27 and 27' in clamping lid 21.

When countersunk screw 24 is subsequently tightened, friction occurs between the countersunk head of countersunk screw 24 and clamping lid 21. Due to this friction, spring disk 26 causes clamping lid 21 to be turned as well which displaces grooves 27 and 27' on the periphery of clamping lid 21 from their aligned position. The grinding tool, including carrier body 1 and grinding element 2, is thereby safely secured.

Grinding element 2 is a flat structure that has a first disk layer and a second disk layer. In the present embodiment, first disk layer 5 is an elastic cushioning layer which may be made of foam rubber or a plastic foam material. First disk layer 5 has a thickness of about 3 mm. Second layer 6 comprises a highly flexible grinding linen.

As shown in FIG. 1, the elements that support grinding element 2, namely carrier body 1 including disk or carrier flange 3 on sleeve 4, have a much smaller diameter than grinding element 2.

FIG. 1 shows that the outside diameter of the highly flexible grinding linen forming the second layer 6 of the disk, is dimensioned so that it freely protrudes beyond the outer edge 8 (see FIG. 2) of first or cushioning layer 5 by a predetermined amount. This overhang is denoted by reference numeral 7.

Figure 2:
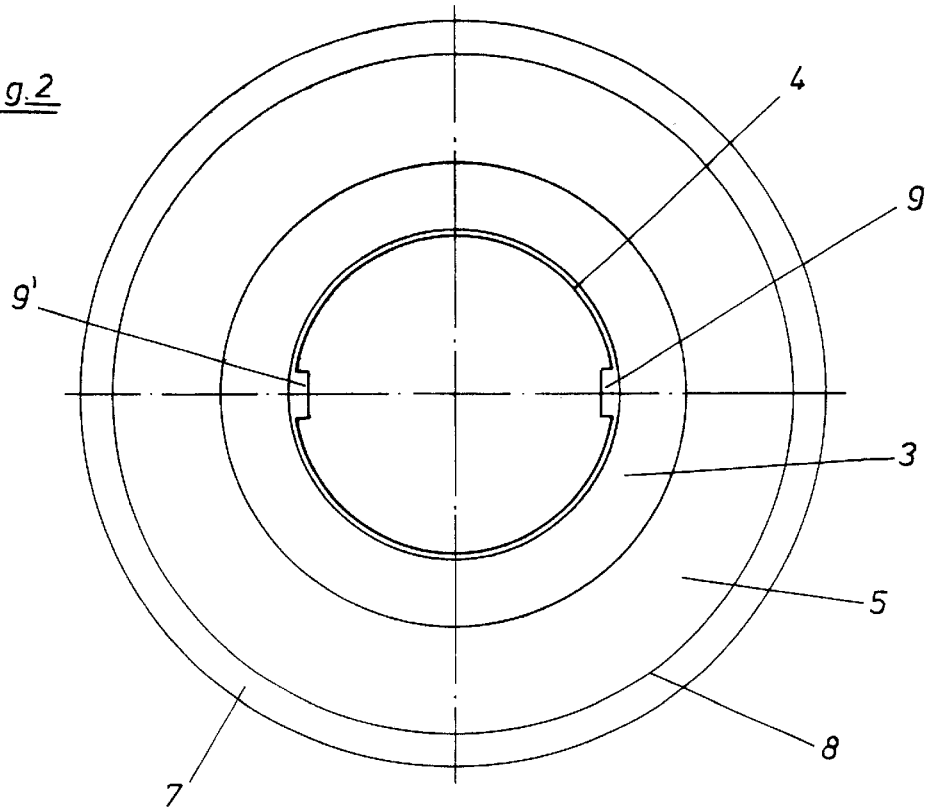
FIG. 2 is a top view of a grinding element of the grinding tool of FIG. 1.
Figure 3:
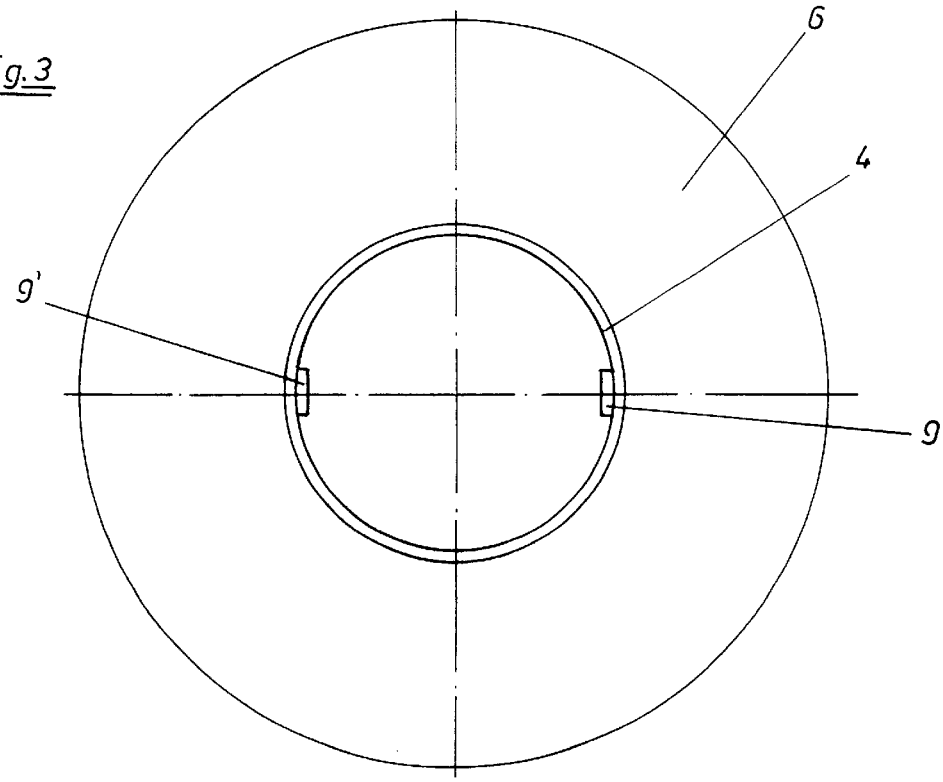
FIG. 3 is a bottom view of the grinding element of FIG. 2.

FIGS. 2 and 3 are top and bottom views, respectively, of the grinding tool, with FIG. 3 showing the grinding surface of the tool that is brought into contact with the workpiece to be treated. As shown in FIGS. 2 and 3, grinding element 1 has the shape of a ring and is assembled from punched or cut components from suitable material layers. Carrier body 1, including disk 3 and drivers 9 and 9', is disposed on sleeve 4 and serves as a collar flange. First layer 5, which serves as the cushioning layer, is an annular disk that is glued to disk or collar flange 3 of the carrier body. Second layer 6, shown in FIG. 3, which is the highly flexible grinding linen, is also an annular disk that is glued to first layer 5, the cushioning layer. The diameter of second layer 6 is dimensioned so that a free, unsupported overhang 7 results, projecting beyond outer edge 8 of the cushioning layer 5 as seen in FIG. 2.

FIG. 3 shows the grinding side of the grinding tool. Visible here are sleeve 4, drives 9 and 9', and only the outer grinding or working surface of the highly elastic grinding linen, i.e. the second disk layer 6.

The grinding tool is a unit that can be prefabricated and used to grind any desired variations and dimensions. After the highly elastic grinding linen has been consumed, the grinding tool can be replaced as a complete structural unit comprising carrier body 1 and grinding element 2 mounted on the carrier body. The clamping pin 18 shown in FIG. 1, is received in a machine drive, which has a clamping device such as an adjustable chuck in most cases. Clamping pin 18 can remain in the chuck of the machine drive throughout the entire grinding work operation. Clamping ring 14 is equipped with an inner bore or recess 17 that allows clamping pin 18 to be inserted therein via a pin foot 19 located on one end of clamping pin 18. The clamping pin can be plugged into an inner bore 17 of the clamping ring 14, the bore forming the threaded blind hole 20. The grooves 15 and 15' located on the periphery of clamping ring 14 receive drivers 9 and 9' in a form-locked manner when carrier body 1 is installed in clamping ring 14. As soon as the drivers have been received in the grooves, a clamping lid 21 is attached on the opposite side, i.e. on the side facing away from clamping pin 18. The clamping lid may be disk-shaped and can be, for example a punched part made of sheet metal. Clamping lid 21 has a countersunk bore 22 in the center for receipt of countersunk screw 24. The outside diameter of clamping lid 21 is about equal to, but not larger than, the inside diameter of sleeve 4 of carrier body 1. Clamping lid 21 is thus countersunk in the sleeve as soon as it has been secured onto pin foot 19 of pin 18 with countersunk screw 24. In this way, all components are assembled and tightened together, with the grinding tool being clamped in between.

Grinding tools present in the form of a complete structural unit comprising the carrier body and the grinding element can be quickly and simply replaced after releasing clamping lid 21, and turning the clamping lid in the manner described above. In this way, clamping pin 18 can remain clamped in the chuck, for example of an electrical machine or hand drill.

While only a single embodiment of the present invention has been shown and described, it is to be understood that many changes and modifications may be made thereunto without departing from the spirit and scope of the invention as defined in the appended claims.

What is claimed is:

1. A grinding tool to be driven by a rotating machine drive comprising:

(a) a carrier body in the form of a disk ring comprising a center sleeve and a collar flange projecting approximately radially from the sleeve, said disk ring being adapted to be coupled for rotation along an axis of rotation to the machine drive at approximately the center of rotation and having at least one working side, said disk ring being thin enough to permit a peripheral area of said disk ring to elastically yield in a transverse plane relative to said disk ring;

(b) a grinding element comprising at least first and second disk layers resting against each other radially disposed in relation to the axis of rotation on said at least one working side, said first layer extending radially beyond an outer edge at said carrier body, said second layer having an outside diameter such that the second layer projects beyond an outer edge of the first layer by a predetermined amount greater than the thickness of the first layer.

2. The grinding tool according to claim 1 wherein a first layer of said a: least two disk layers is an elastic cushioning layer, and a second layer of said at least two disk layers is a highly flexible grinding linen.

3. The grinding tool according to claim 1 wherein the disk ring has a thickness approximately equal to one twentieth of its width.

4. The grinding tool according to claim 1 wherein the carrier body is a single-piece molded part made of glass fiber-reinforced polyamide.

5. The grinding tool according to claim 1 wherein said grinding element has a central opening having a diameter approximately equal to but not less than the outside diameter of the sleeve of the carrier body; and wherein said grinding element is fitted via the opening onto the sleeve, so that said first layer rests against the disk ring, and said grinding element is fixed to said disk ring.

6. The grinding tool according to claim 5 wherein the first disk layer of the grinding element has an outside diameter approximately equal to three times the width of the disk ring.

7. The grinding tool according to claim 5 wherein the first disk layer of the grinding element has a thickness about three times the thickness of the disk ring.

8. The grinding tool according to claim 1 wherein the disk ring has an outer diameter of about 70 mm, a width of about 10 mm and a thickness of about 1 mm.

* * * * *